United States Patent [19]

Kato

[11] Patent Number: 4,579,447

[45] Date of Patent: Apr. 1, 1986

[54] COPY PAPER FEEDING DEVICE TO TRANSFER PORTION IN AN ELECTROPHOTOGRAPHIC COPYING MACHINE

[75] Inventor: Itsurou Kato, Nara, Japan

[73] Assignee: Sharp Kabushiki Kaisha, Osaka, Japan

[21] Appl. No.: 579,201

[22] Filed: Feb. 10, 1984

[30] Foreign Application Priority Data

Feb. 15, 1983 [JP] Japan ..... 58-24314

[51] Int. Cl.[4] ..... G03G 15/00; G03G 15/14

[52] U.S. Cl. ..... 355/3 SH; 355/14 SH; 355/3 TR; 271/3; 271/109

[58] Field of Search ..... 355/3 SH, 14 SH, 13, 355/3 TR, 14 TR; 271/3, 3.1, 7, 109, 225, 314, 264

[56] References Cited

U.S. PATENT DOCUMENTS 4,247,839 1/1981 Takizawa ..... 355/3 SH X
4,362,378 12/1982 Erskine et al. ..... 355/3 SH X
4,391,510 7/1983 Cherian ..... 355/3 SH
4,412,734 11/1983 Shibuya et al. ..... 355/3 SH

*Primary Examiner*—A. C. Prescott
*Attorney, Agent, or Firm*—Birch, Stewart, Kolasch & Birch

[57] ABSTRACT

An electrophotographic copying machine comprises a feeding device for feeding a copy paper to a circular photoreceptor for forming an electrostatic latent image thereon, a transfer discharger for causing a corona discharge to transfer the latent image onto the copy paper, and a receiving device for receiving the copy paper posterior to the corona transfer. The copy paper is traversed along a tangent line of the transfer portion of the circular photoreceptor, the tangent line extending substantially in a line through the feeding device, the corona discharger, and the receiving device. The copy paper may be selected to be thick or thin. The thick copy paper can be automatically separated from the circular photoreceptor without the aid of any separation means.

3 Claims, 2 Drawing Figures

COPY PAPER FEEDING DEVICE TO TRANSFER PORTION IN AN ELECTROPHOTOGRAPHIC COPYING MACHINE

BACKGROUND OF THE INVENTION

The present invention relates to an electrophotographic copying machine and, more particularly, to a feeding device for feeding copy paper to a transfer portion or position of a photoreceptor.

An electrophotographic copying machine produces on a photoreceptor an electrostatic latent image corresponding to a pattern image of a document such as a manuscript or book to be copied. Toner particles are electrostatically attracted to the latent image, so that the latent image becomes visible as a toner image. The toner image is transferred onto the copy paper via a transfer corona discharger.

Conventionally, when the copy paper is close to the photoreceptor to transfer the toner image onto the copy paper, the copy paper may be bent so that the surface of the copy paper is close to the surface of the drum carrying the photoreceptor. That is, the plane of the surface of the copy paper close to the photoreceptor cannot include the tangent line at the surface of the photoreceptor because the respective elements of the conventional paper feeding devices for forwarding the copy paper near the surface of the photoreceptor are positioned so as to curve the copy paper during the traverse.

When the copy paper is so thin that it is flexible, such a copy paper can be brought to the surface of the photoreceptor, smoothly. However, when the copy paper is so thick that it is not flexible but instead very stiff, such a copy paper may possibly jam in the copy paper feeding device since it is difficult to bend such a copy paper into a smooth curve.

Therefore, it is desired to provide an improved paper feeding device for feeding any kind of copy paper regardless of thickness.

SUMMARY OF THE INVENTION

Accordingly, it is an object of the present invention to provide an improved paper feeding device for feeding a copy paper into close proximity to a photoreceptor so as to effect the imagewise transfer of toner particles to the surface of the copy paper.

It is another object of the present invention to provide an improved paper feeding device for forwarding a copy paper close a photoreceptor so that the plane of the copy paper includes a tangent line with the photoreceptor.

It is a further object of the present invention to provide an improved paper feeding device for forwarding a thick copy paper close a photoreceptor so that the plane of the thick copy paper forms a tangent line with the photoreceptor.

Briefly described, in accordance with the present invention, an electrophotographic copying machine comprises a guide means for guiding a copy paper into close proximity to a photoreceptor having an electrostatic latent image thereon, a transfer means for transferring toner particles which develope the latent image onto the copy paper, and a receiving means for receiving the copy paper following the transfer by the transfer means. The copy paper is traversed along a tangent line at the transfer position of the photoreceptor, the tangent line extending substantially in a line through the guide means, the transfer means, and the receiving means. The copy paper may be selected to be thick or thin. The thick copy paper may be automatically separated from the photoreceptor without the aid of a separation means.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
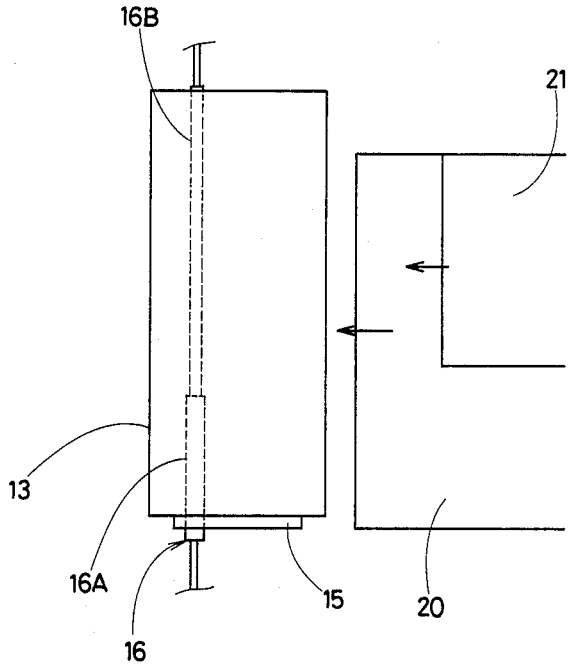
FIG. 1 is a plan view of a paper feeding device according to the present invention.
Figure 2:
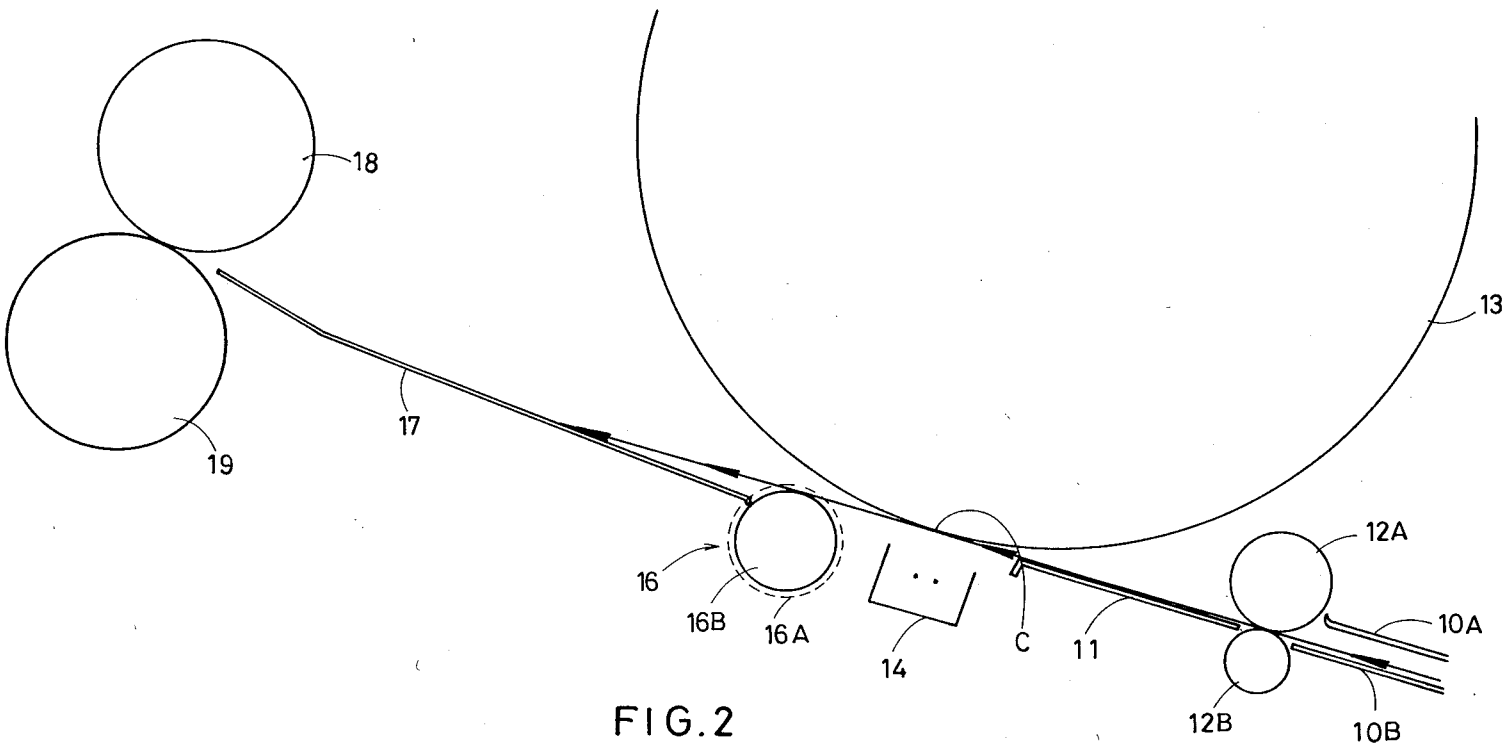
FIG. 2 is a side view of the paper feeding device of FIG. 1.

FIG. 1 shows a plan view of a paper feeding device of the present invention. FIG. 2 shows a side view of this paper feeding device.

Referring now to FIGS. 1 and 2, responsive to the application of incident light corresponding to a light pattern of a document to be copied, a photoreceptor 13 is provided around a drum for forming an electrostatic latent image thereon. The paper feeding device discussed above comprises a pair of paper guides 10A and 10B for guiding the introduction of a thin paper 20 or a thick paper 21 to the photoreceptor 13. For example, as FIG. 1 shows, the thin paper 20 is larger wider than the thick paper 21. Normally, the thick paper 21 will be a postal card or a book-card, etc. A feed guide 11 is provided for guiding the copy paper 20 or 21 to the photoreceptor 13. A pair of feed rollers 12A and 12B are provided for feeding the copy paper 20 or 21 to the photoreceptor 13. These rollers 12A and 12B are positioned midway between the paper guides and the photoreceptor 13. A transfer corona discharger 14 is provided for causing a corona discharge onto the copy paper close to the photoreceptor 13 so as to transfer a toner image from the photoreceptor 13 to the copy paper. A separation roller 16 is provided for separating the copy paper from the photoreceptor 13. A separation guide 15 is provided for guiding the separated copy paper. A guide plate 17 is provided for forwarding the separated copy paper to a pair of fixing rollers 18 and 19 for fixing the transferred toner image to the copy paper, preferably, by heating.

According to the present invention, as FIG. 1 shows, the separation roller 16 is provided with two sections including a large-diameter roller 16A and a small-diameter roller 16B. The large-diameter roller 16A is used to separate the thin copy paper 20 from the photoreceptor 13. The small-diameter roller 16B is used to separate the thick copy paper 21 from the photoreceptor 13. The large-diameter roller 16A is positioned adjacent the separation guide 15 so that the large-diameter roller 16A and the separation guide 15, in combination, grasp an end of the thin copy paper 20 close to the photoreceptor 13 so as to separate the thin paper 20 from the photoreceptor 13. The small-diameter roller 16B positioned far from the separation guide 15, so that the small-diameter roller 16B and the separation guide 15 cannot grasp the thick paper 21 to separate it from the photoreceptor 13.

The thick paper 21, such as a postal card, is transferred along a traverse or transfer path different from the traverse path of the thin paper 20, as shown in FIG.

1, such that the thick paper 21 is transferred to the corona transfer portion far from the separation means comprising the large-diameter roller 16A and the separation guide 15. During traversing of the thick paper 21, the large-diameter roller 16A of the separation roller 16 is prevented from facing or contacting the thick paper 21, so that the small-diameter roller 16B should face or contact the paper 21. Here, a cassette for storing the thick papers 21 or an opening for manually inserting the thick papers 21 into the copying machine is positioned so that the thick paper 21 is transferred along a transfer route separate from the path leading the thin paper to the separation means comprising the large-diameter roller 16A and the separation guide 15.

According to the present invention, as FIG. 2 shows, the transfer path defined by the paper guides 10A and 10B, the feed guide 11, the guide plate 17, the feed roller 12, the photoreceptor 13, and the separation rollers 16A and 16B are in line, substantially. To direct the thick paper 21 into close contact with the photoreceptor 13 during the corona transfer, preferably, the feed guide 11 is positioned near the photoreceptor 13. Since, in view of the close contact of the thick paper 21 with the photoreceptor 13, the transfer path defined by the feed guide 11 and the photoreceptor 13 should not deviate, from a plane shown in FIG. 2, from an exact linear transfer path, preferably, the exact linear transfer or traverse path should be maintained between the feed guide 11 and the corona discharge portion on the photoreceptor 13. After passing the corona transfer position following the corona transfer, it is permissible for the traverse path to be curved somewhat. Therefore, preferably, an end of the feed guide 11 for feeding the thick paper 21 is close to the photoreceptor 13 and, in addition, the transfer path in this section should be designed to be substantially in a line so that the copy paper 20 or 21 contacts the photoreceptor 13 so as to form a tangent line at a point C of the transfer portion of the photoreceptor 13.

To direct the thick paper 21 after the corona transfer, the separation roller 16B is somewhat displaced from the exact linear transfer path taking care not to jam the paper 21. Preferably, the separation roller 16B is made of a foamed neoprene resin to increase the contact area between the paper 21 and the roller 16B to thereby provide a good paper feeding property.

Regarding the thin paper 20, when the thin paper 20 is transferred by the feed rollers 12A and 12B, and the feed guide 11, the thin paper 20 is directed to the tangential point C at the transfer portion or position of the photoreceptor 13. When the thin paper 20 is close to the photoreceptor 13, the corona discharge is provided by the corona discharger 14 to transfer the toner image onto the thin paper 20. The end of the thin paper 20 is separated from the photoreceptor 13 by the separation guide 15, the end being gripped by the separation guide 15 and the large-diameter roller 16A. Here, as the large-diameter roller 16A is rotated, the thin paper 20 is gradually separated from the photoreceptor 13. The separated thin paper 20 is forwarded via the guide plate 17 to the pair of fixing rollers 18 and 19.

Regarding the thick paper 21, it is guided without the end thereof being gripped by a separation means as being different from the thin paper 20. The thick paper 21 is forwarded to the feed guide 11, so that it is directed to the tangential point C of the transfer, portion of the photoreceptor 13. The corona transfer, transferring the toner image onto the thick paper 21 is carried out by the transfer corona discharger 14 while the thick paper 21 is close to the photoreceptor 13. Owing to the stiffness of the thick paper 21 itself, the paper 21 is automatically separated from the photoreceptor 13. Since the thick paper 21 is normally small and stiff, it can be separated from the photoreceptor 13 owing to the stiffness even after being brought into close proximity to the photoreceptor 13 for the corona transfer. No specific separation means is provided for separating the thick paper 21 from the photoreceptor 13, this being different from the case of the thin paper 20. It is to be noted that the size of the thick paper 21 is not limited to the small size as in the case of a postal card.

While only certain embodiments of the present invention have been described, it will be apparent to those skilled in the art that various changes and modifications may be made therein without departing from the spirit and scope of the present invention as claimed.

What is claimed is:

1. A device in an electrophotographic copying machine for feeding a copy paper to a circular photoreceptor means for forming an electrostatic latent image thereon, having a transfer means for transferring toner particles used to develop said latent image from a transfer portion of the circular photoreceptor means onto the copy paper, the improvement comprising:

providing a guide means for forwarding said copy paper to said circular photoreceptor means; and a receiving means following said guide means for receiving said copy paper after passing said transfer means;

said copy paper being transferred along a path in a plane tangent at the transfer portion of said photoreceptor means, said transfer path extending substantially in a line through said guide means, said transfer means, and said receiving means, said receiving means comprising a roller provided with a large-diameter portion and a small-diameter portion for transferring both thin and thick copy paper, respectively.

2. The device of claim 1, further comprising a separation means for separating said thin copy paper from said photoreceptor means.

3. The device of claim 1, wherein said receiving means deviates from the exact linear path defined by said plane tangent at said transfer portion of said circular photoreceptor means.

* * * * *